US005876310A

United States Patent [19]

Mackey et al.

[11] Patent Number: 5,876,310

[45] Date of Patent: Mar. 2, 1999

[54] UPPER BODY EXERCISE DEVICE

[75] Inventors: Teri R. Mackey, 266 Las Lomes Dr., Novato, Calif. 94949; Kenneth Tarlow, Corte Madera, Calif.

[73] Assignee: Teri R. Mackey, Novato, Calif.

[21] Appl. No.: 971,708

[22] Filed: Nov. 17, 1997

[51] Int. Cl.[6] ..... A63B 64/10

[52] U.S. Cl. ..... 482/74; 482/49; 482/114; 482/124

[58] Field of Search ..... 482/127, 124, 482/121, 116, 74, 126, 49, 114

[56] References Cited

U.S. PATENT DOCUMENTS

| | | | |
|---|---|---|---|
| 766,743 | 8/1904 | Terry | 482/127 |
| 885,074 | 4/1908 | Nidever | 482/127 |
| 3,785,644 | 1/1974 | Bradley et al. | 482/127 |
| 5,358,461 | 10/1994 | Bailey, Jr. | 482/124 |
| 5,476,435 | 12/1995 | Nimmo | 482/124 |
| 5,484,366 | 1/1996 | Wilkinson | 482/124 |
| 5,509,893 | 4/1996 | Corn | 482/124 |
| 5,618,249 | 4/1997 | Marshall | 482/124 |

*Primary Examiner*—Jerome W. Donnelly

[57] ABSTRACT

An upper body exercise device designed to be used by a person while walking. The device consists of a belt to which a pair of cables is attached. The cables are retractable and roll up automatically, via a spring reel assembly, onto spools located within a pair of handgrips. The user grasps the handgrips and pulls outwardly while walking. The force required to pull the handgrips outwardly can be increased or decreased by turning an adjustment knob located on the outside of each handgrip. The adjustment knob causes a frictional force to be exerted on the cable spool making it easier or harder to pull the cable out. Straps are provided on each side of the belt to store the handgrips when not in use. Obviously the device of the present invention may also be used while in a stationary position or while jogging.

6 Claims, 6 Drawing Sheets

UPPER BODY EXERCISE DEVICE

BACKGROUND OF THE PRESENT INVENTION

The present invention relates to exercise devices and more particularly to an upper body exercise device for people of all ages.

Many means of exercising exist for improving ones muscular tone and for producing an aerobic workout. One popular way of getting aerobic exercise is to take a brisk walk. Walking is a low impact exercise, which does not put excess strain on the body's joints and yet gives strength and tone to the lower body. Unfortunately, the upper body does not get as much of a work out during the act of brisk walking. There are some exercise aids available on the market for exercising the upper body while walking. The most common devices are hand weights, which the user holds in his or her hand while swinging the arms and walking. There are several problems with hand weights however. Firstly, the amount of weight can not be easily adjusted while walking so if a person begins to feel fatigue with a heavy weight he or she can not easily switch to a lighter weight. Second, if the user wishes to discontinue the use of the weights while walking, he or she has no convenient place to put them. Even if a person puts them in a separate bag or pack, the person must still bear the extra weight of the hand weight devices. Finally, there are only a limited number of exercises one can do with traditional hand weights, which include normal arm swinging, arm curling and over head presses. These exercises act on primarily the arm muscles rather than the entire upper body and even then, only in a limited way, on selected muscle groups.

OBJECTS AND SUMMARY OF THE PRESENT INVENTION

It is an object of the present invention to solve the above stated limitations of traditional hand weights when used to effect an upper body workout while walking. It is an object of the present invention to provide an upper body exercise device in which the amount of force exerted while exercising can be easily increased or decreased while walking. It is an additional object of the present invention to provide an upper body exercise device, which is relatively lightweight and can be easily stored while walking. It is a further object of the present invention to provide an upper body exercise device, which can exercise most of the muscle groups of the upper body while a person is walking. Additionally it is an object of the present invention to provide an upper body exercise device, which is easy and economical to manufacture.

The above mentioned objects are accomplished by providing a pair of hand grips which have contained within them a spool of nylon cable attached to a spring return reel. The retractable cable exits the handgrip and is attached at its opposite end to a belt, which the user wears around his or her waist. An adjustment knob on the outside of each hand grip can increase or decrease the amount of force required to extend the hand grip away from the belt thereby giving the user an upper body workout. The entire apparatus is relatively lightweight and the handgrips can be stored, via Velcro straps on the belt. Because a resistance force is created by the effort needed to pull the cable out from the handgrip and away from the belt, a wide variety of muscles toning exercises can be practiced by pulling on the handgrip in various positions which will be described below. The entire device is easy and economical to manufacture and would be easily affordable by the general public. It is obvious that a person may also use the upper body exercise device of the present invention while standing still or while jogging as well as while walking.

GENERAL DESCRIPTION OF THE DRAWINGS

DETAILED DESCRIPTION OF THE PRESENT INVENTION

Figure 1:
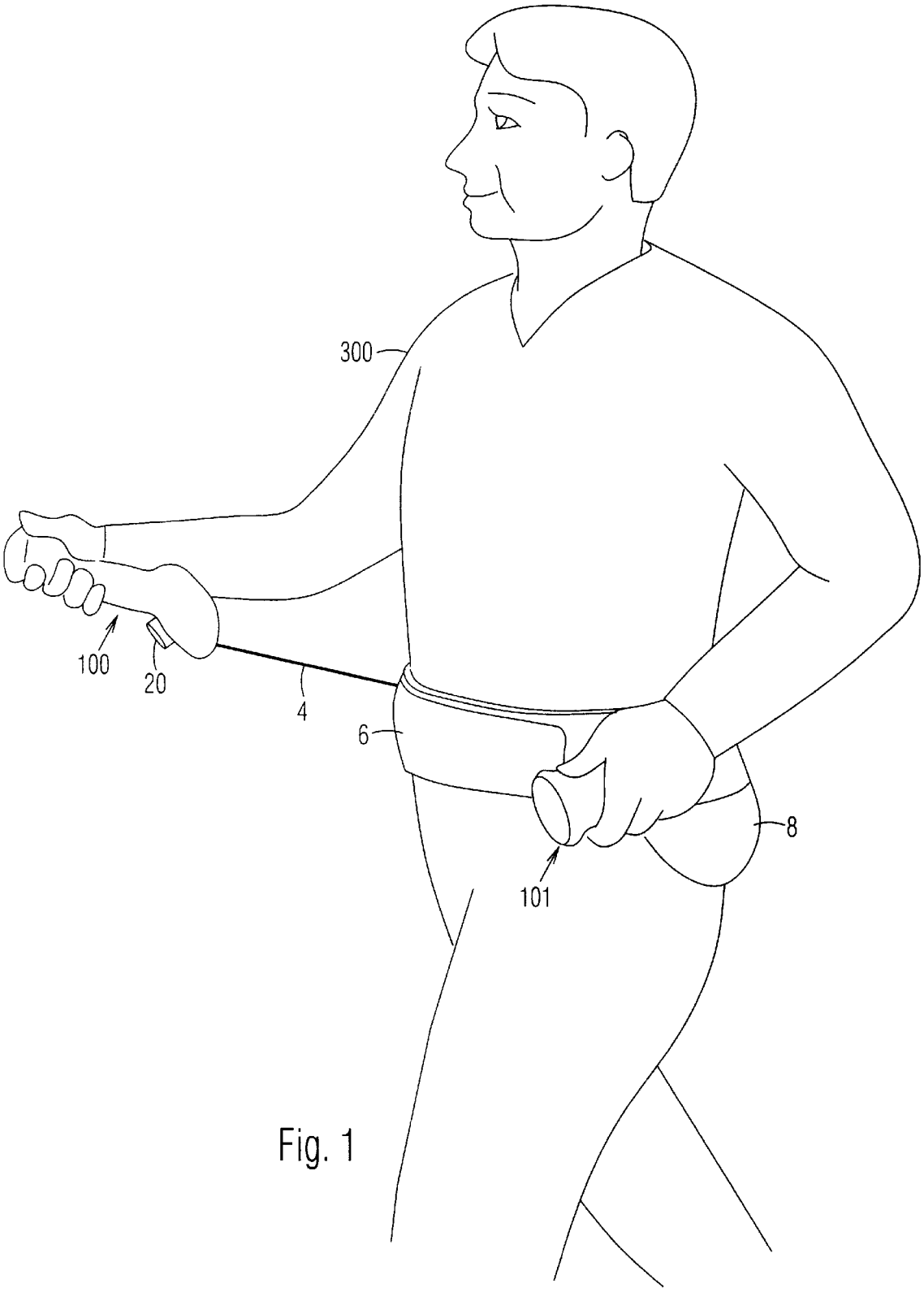
FIG. 1 is a perspective view of a person using the upper body exercise device of the present invention.
Figure 2:
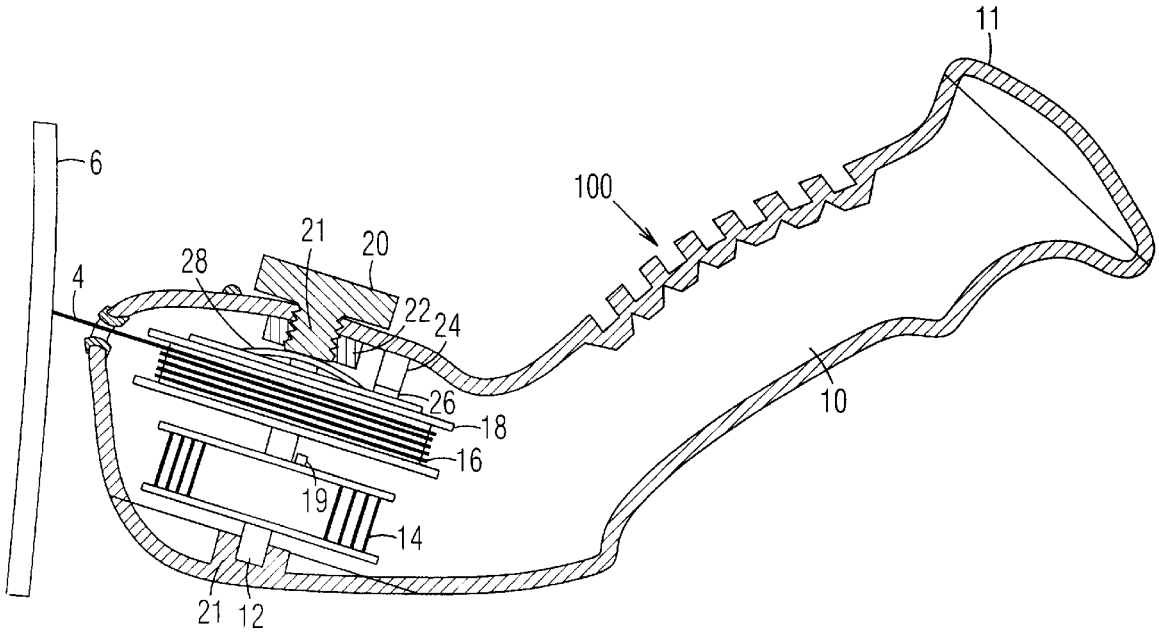
FIG. 2 is a side section view of the handgrip of the upper body exercise device of the present invention.
Figure 3:
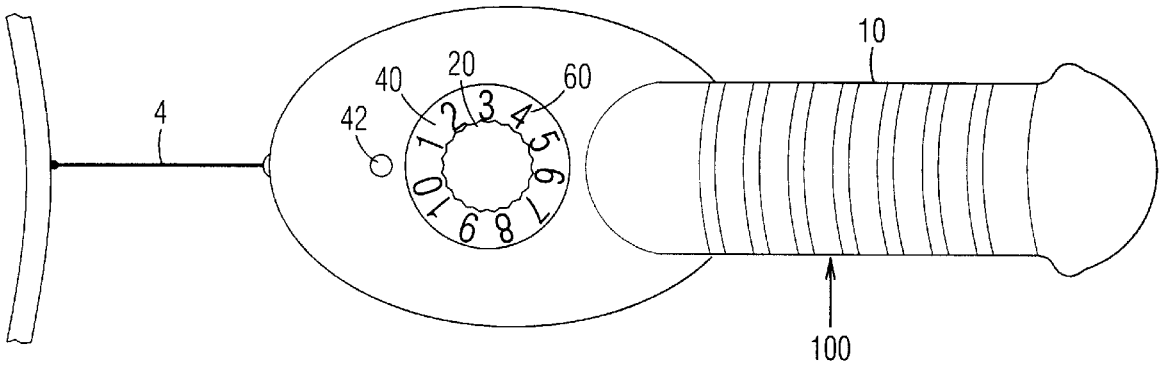
FIG. 3 is a top view of the handgrip of the upper body exercise device of the present invention.
Figure 4:
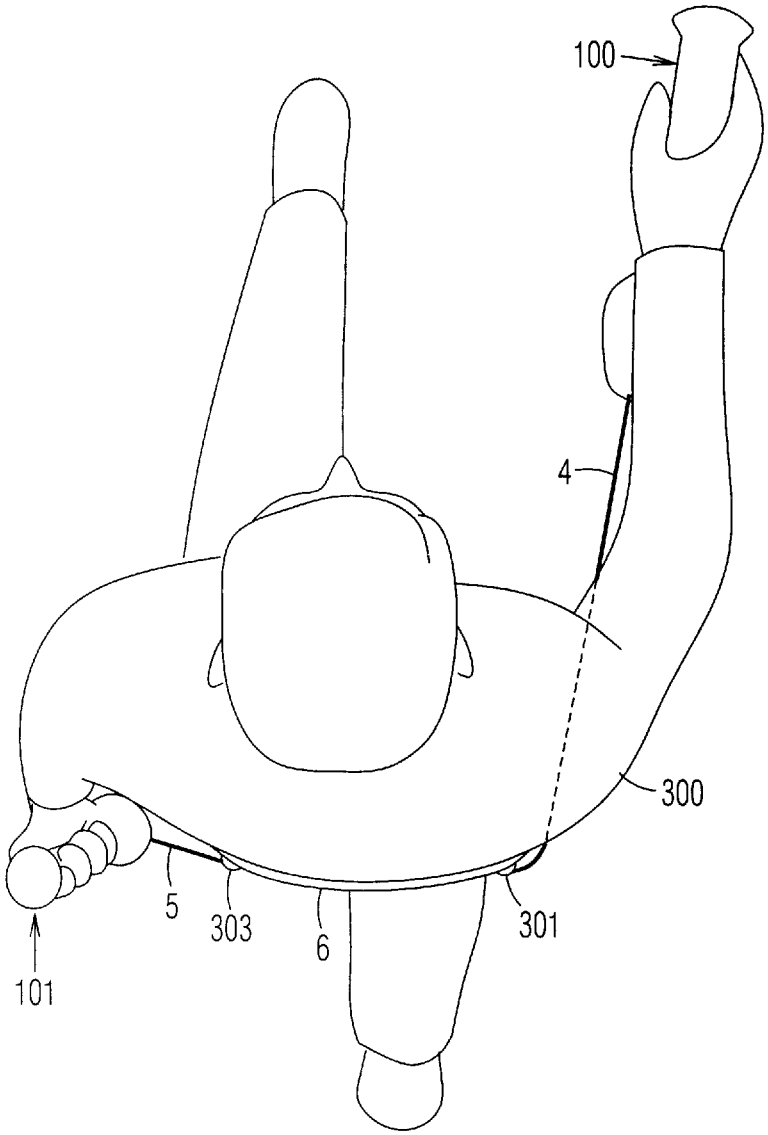
FIG. 4 is a top view of a person using the upper body exercise device of the present invention.
Figure 5:
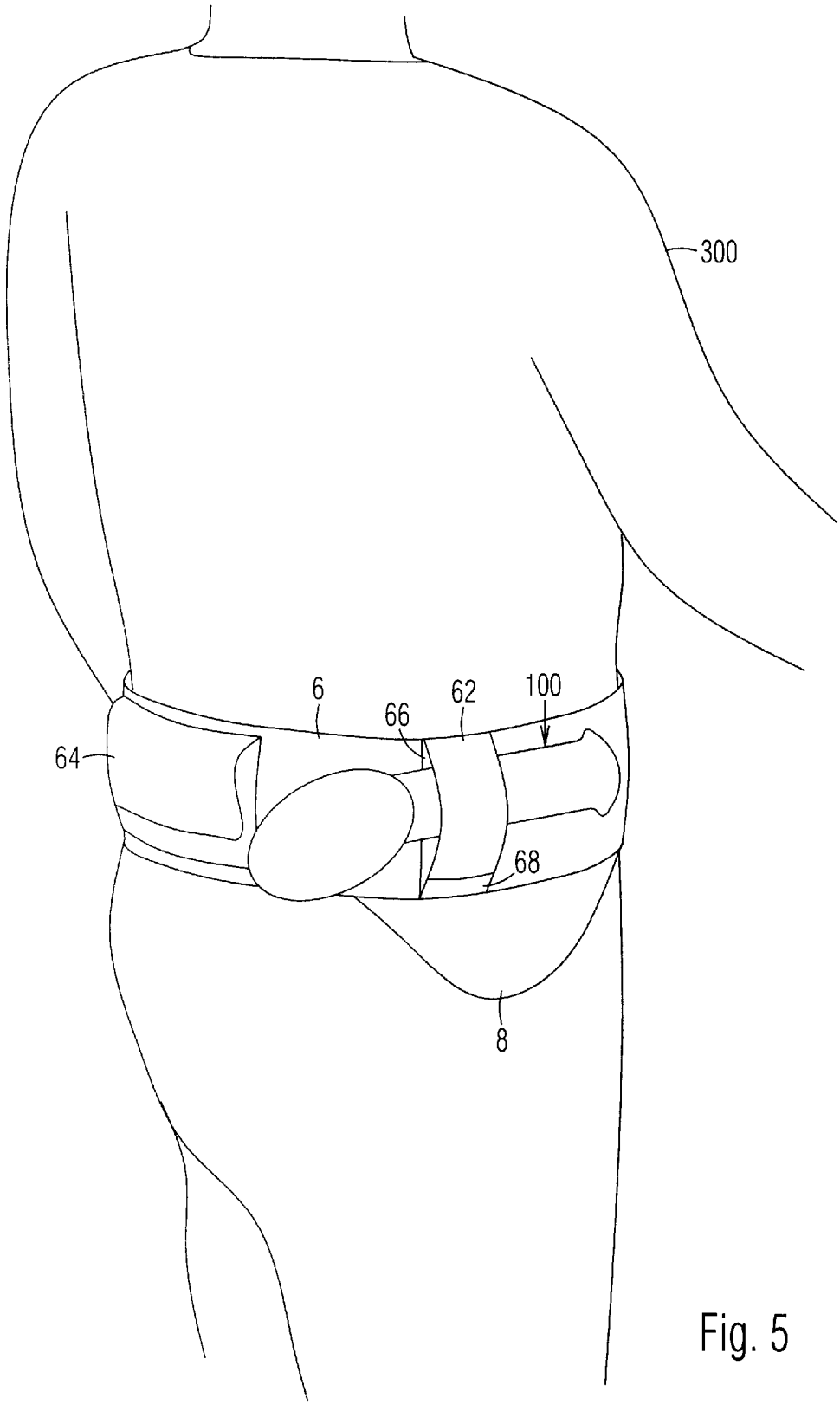
FIG. 5 is a side view of a person wearing the upper body exercise device of the present invention while the device is in the stored position.
Figure 6:
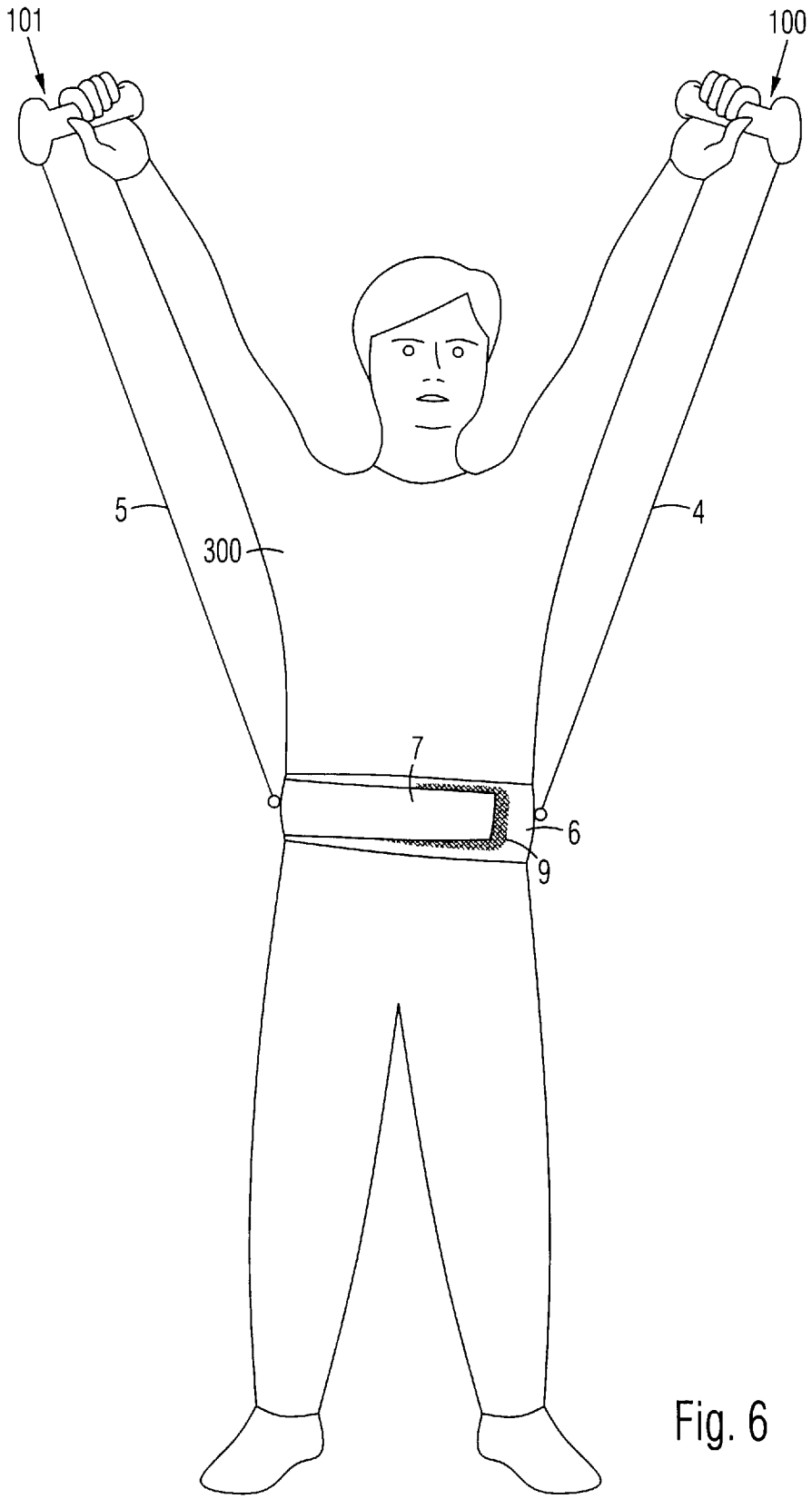
FIG. 6 is a front view of a person doing over the head exercises with the upper body exercise device of the present invention.

Referring now to FIG. 1, we see a person 300 walking briskly. In each hand is a handgrip assembly 100, 101. A retractable cable 4 exits from the bottom portion of the hand grip assembly 100, 101 and is attached at its opposite end to a belt 6. Additional flaps 8 are attached to the belt to help prevent chaffing as the cable 4 rubs against the sides of the buttock area. The user can adjust the degree of force needed to pull the cable 4 from the handgrip assembly 100 by turning knob 20. FIG. 2 shows a side section view of the handgrip assembly 100. Cable 4 is attached at one end to belt 6 and at the other end is rolled 16 onto spool 18. Spool 18 is connected by a common rotatable shaft 19 to spring reel 14. Spring reel 14 causes a constant force of about one pound to be exerted on cable 4 as it is pulled out from opening 50 so that the cable 4 automatically retracts after it has been pulled out. Knob 20 has a threaded stem 21, which is screwed into the handgrip housing 22. Belleville spring washer 28 acts as a means of adjustable resistance as it presses against rotating plate 26. Rotating plate 26 has ratchet teeth at its outer perimeter, which are engaged by pawl 24. The ratchet action allows the cable 4 to progress inwardly towards the handgrip without undo frictional force. The outward pulling action on cable 4 is resisted by the tension caused by Belleville spring washer 28. By turning adjustment knob 20 the user can vary the amount of force needed to pull the cable 4 out. The force can be as little as one pound and as much as 15 pounds. Handle grip 10 is slightly curved to provide a comfortable grip for the user. The end of handle 10 is flared out 11 to give the user an opposing surface as he or she pulls on cable 4. The entire lower portion of handgrip assembly 100 is angled at about thirty degrees so that cable 4 can pull out of hole 50 without undo chaffing against the edges of exit hole 50. FIG. 3 shows a top view of handgrip assembly 100. Adjustment knob 20 has an attached skirt 40 with numerals or other indicating marks printed on it. Stationary indicator dot 42 is located on the top surface of the assembly 100 so that a user can visually see the degree of resistance he or she is causing as adjustment knob 20 is turned. FIG. 4 shows a top view of a person using the upper body exercise device of the present invention. Cables 4, 5 are attached to belt 6 at points 301 and 303. These points are ideal because the back stroke of the users arm ends approximately at this location so the user can get full extension force as he or she swings their arm forward. FIG. 5 shows a side view of a person's body while he or she is wearing the upper body-exercising device of the present invention. Handgrip assemblies 100, 101 can be stored on belt 6 by use of straps 62. Strap 62 is sewn to belt 6 at the bottom 68 and a hook and loop type fastener removably hold the top of strap 62 top belt 6 at the top 66. Pack 64 is attached to belt 6 and can be used to carry devices such as an audio tape player, radio, C.D. player or the like. FIG. 7 shows a front view of a person wearing the upper body exercise device of the present invention. Belt 6 is held in an adjustable yet fixable position by use of hook and loop fastening material located on the belt end 7 and the belt body 9. The user 300 in this illustration has reversed the direction of handgrip assemblies 100, 101 for use in a variety of lifting exercises. Because of the resistance factor created by the user 300 pulling his or her arms away from the body, many muscle groups can be exercised including ones in the upper chest, back, abdomen as well as the arms.

In this way, while wearing the exercise device of the present invention, a person can receive a vigorous upper body workout while walking. The user has the option of setting the resistance levels and can also store the device while walking. The exercise device of the present invention is easy and economical to manufacture. The housing is made of rigid, injection molded plastic. The handgrip area may be molded out of a more flexible plastic or rubber-like covering. The spring reel is made in the conventional manner of spring steel material. The cable 4 can be made of nylon or other strong, flexible material including stranded steel cable or bead-chain.

Although the above drawings and description of the drawings show a preferred embodiment, it is to be understood that there may be other embodiments of the present invention which would be obvious to one versed in the art of exercise devices and which would therefore be protected by the scope and spirit of the present invention. For example, the spring reel and cable assembly could be attached to the belt and the opposite end of the cable could be fixedly attached to the handgrip.

Therefore we claim:

1. An upper body exercise device comprised of a pair of hollow hand-grips, a pair of retractable cables and a waist belt; said cables being attached at one end to said belt and at the opposite end to a cable spool located within said hollow hand-grip, said spool attached to a spring reel assembly, said spool being frictionally acted upon by force by a threaded stem, said stem being attached to an adjustment knob, said stem acting on a spring washer thereby causing resistance force on the top surface of said rotating cable spool, said cable spool top having ratcheted teeth at its perimeter, said ratchet teeth being engaged by a mating pawl member thereby allowing unimpeded retraction of said cable while allowing a frictional force to be in effect during the outward stroke of the cable.

2. An upper body exercise device as claimed in claim 1 wherein said handle-grips can be removably stored on said belt by means of straps, said strap being permanently attached at the lower end and removably attached by means of hook and loop type fasteners at the upper end.

3. An upper body exercise device as claimed in claim 1 wherein said adjustment knob has an attached skirt, said skirt having a plurality of indicating marks, said marks located adjacent to a stationary indicating mark located on the top surface of said hand-grip.

4. An upper body exercise device as claimed in claim 1 wherein said belt has a pair of flaps extending from the lower edge to protect the user from abrasion caused by said cable while in use.

5. An upper body exercise device as claimed in claim 1 wherein an accessory pocket is attached to said belt.

6. An upper body exercise device as claimed in claim 1 wherein said belt is adjustable fastened firmly around the users waist by use of a hook and loop type fastener attached to the body and end of said belt.

* * * * *